United States Patent [19]

Langen et al.

[11] Patent Number: 5,075,207

[45] Date of Patent: Dec. 24, 1991

[54] COLOR PHOTOGRAPHIC RECORDING MATERIAL CONTAINING NEW COLORED CYAN COUPLERS

[75] Inventors: Hans Langen, Bonn; Günter Renner, Gladbach; Jürgen Plamper, Leverkusen, all of Fed. Rep. of Germany

[73] Assignee: Agfa Gevaert AKtiengesellschaft, Leverkusen, Fed. Rep. of Germany

[21] Appl. No.: 694,822

[22] Filed: May 2, 1991

Related U.S. Application Data

[63] Continuation of Ser. No. 341,698, Apr. 21, 1989, abandoned.

[30] Foreign Application Priority Data

May 6, 1988 [DE] Fed. Rep. of Germany ..... 3815469

[51] Int. Cl.[5] ..... G03C 1/08; G03C 7/34

[52] U.S. Cl. ..... 430/549; 430/552; 430/553

[58] Field of Search ..... 430/504, 549, 552, 553

[56] References Cited

U.S. PATENT DOCUMENTS 4,294,900 10/1981 Aono ..... 430/504

4,833,069 5/1989 Hamada et al. ..... 430/496

FOREIGN PATENT DOCUMENTS 62-168142 7/1987 Japan ..... 430/504

*Primary Examiner*—Charles L. Bowers, Jr.

*Assistant Examiner*—Janet C. Baxter

*Attorney, Agent, or Firm*—Connolly & Hutz

[57] ABSTRACT

Colored cyan couplers corresponding to formula II are eminently suitable for masking the yellow secondary density of cyan dyes. The reproduction of blues and yellows is thus improved. The colored cyan couplers of formula II are preferably used together with phenolic cyan couplers bearing a phenylureido group in the 2-position and an acylamino group with a ballast group in the 5-position

II

In formula II:

CC represents a cyan coupler group to the coupling position of which L is attached;

L is a bifunctional connecting group;

$Q^1$, $Q^2$ represent H or photographially inert substituents;

R represents a coupling component such that the compound of formula II is a yellow dye.

III

IV

V in which $R^3$ is alkyl, aryl, carboxyl, carbamoyl, acylamino, anilino;

$R^4$ is H, alkyl, aryl, a heterocyclic group;

$R^5$, $R^6$ (same or different) represent -CO-alkyl, -CO-aryl, -CO-alkoxy, carbamoyl, -CN;

represents O, S, NH;

Z is the group required to complete a 5- or 6-membered carbocyclic or heterocyclic ring.

2 Claims, No Drawings

COLOR PHOTOGRAPHIC RECORDING MATERIAL CONTAINING NEW COLORED CYAN COUPLERS

CROSS REFERENCE TO RELATED APPLICATION

This is a continuation of copending application Ser. No. 07,341,698, filed Apr. 21, 1989, now abandoned, by Hans Langen et al for "Color Photographic Recording Material Containing New Colored Cyan Couplers."

This invention relates to a color photographic recording material containing new colored cyan couplers.

Colored photographic images are normally produced by chromogenic development in which silver halide emulsion layers which have been exposed to form an image are developed in the presence of suitable color couplers by means of suitable dye-producing developers, so-called color developers. A coupling reaction takes place between the color developer oxidation product, which is formed in image-wise accordance with the silver image produced, and the color coupler with formation of a dye.

Naphtholic or phenolic cyan couplers are normally used for the production of the cyan component image. In color photographic recording materials, preference has hitherto been attributed to naphtholic cyan couplers by virtue of the more favorable absorption (at approximately 700 nm) of the image dyes produced from them during chromogenic development. By contrast, phenolic cyan couplers generally give dyes having an absorption maximum at shorter wavelengths.

Although naphtholic cyan couplers are ideal in spectral terms, particularly when used in color negative films, they are attended by a serious disadvantage in the inadequate stability properties of the dyes and in particular in their inadequate stability to moisture and heat. Phenolic cyan couplers are preferred to naphtholic cyan couplers in this regard. As already mentioned, however, the dyes produced from them show excessive absorption at short wavelengths and, as a result, have an excessive, undesirable secondary density both in the green and in the blue spectral region. This leads to desaturated color reproduction in the copier material unless the excessive secondary densities in the color negative film are compensated by additional measures, for example by the use of mask couplers.

EP-A-0 028 099 and EP-A-0 067 689 describe phenolic cyan couplers which contain a phenyl ureido group substituted in the benzene ring in the 2-position of the phenol ring. Although, on color development, these couplers give dyes having high stability and a comparatively long-wave absorption maximum, the dyes thus produced still show comparatively high secondary densities.

Where mask couplers are used, their natural color is degraded imagewise in consequence of development and coupling with the developer oxidation products to form a mask image which shows opposite gradation to the dye image formed simultaneously from the coupler. Providing a suitable mask coupler is chosen, its natural color corresponds to the unwanted secondary density of the image dye which, given suitable dosage of the mask coupler, becomes gradationless through super imposition of the mask image and can be compensated by the use of suitable color filters during copying onto the copying material. Accordingly, the use of mask couplers is an excellent way of improving color reproduction.

The mask couplers typically used together with colorless cyan couplers are red to magenta in color. Accordingly, they are primarily suitable for masking the magenta secondary density of the cyan image dyes. However, the yellow secondary density of the cyan image dyes remains largely unconsidered in this regard. This is all the more noticeable when the cyan couplers used are cyan couplers from which image dyes are produced with a comparatively high yellow secondary density (and a comparatively lower magenta secondary density), as for example in the case of certain phenolic cyan couplers which are preferable to the naphtholic cyan couplers by virtue of their better stability properties. Inadequate masking of the yellow secondary density is reflected in unsatisfactory reproduction of blues and yellows.

The present invention relates to a color photographic recording material comprising at least one photosensitive silver halide emulsion layer which is applied to a layer support and with which a colorless cyan coupler and a colored cyan coupler are associated, characterized in that the colorless cyan coupler corresponds to formula I

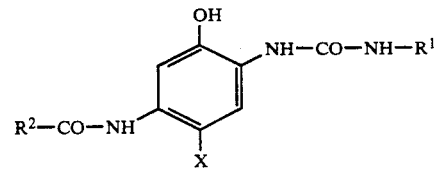

I in which

X represents H or a group releasable during the coupling reaction;

$R^1$ is a heterocyclic group or aryl;

$R^2$ is a ballast group;

and in that the colored cyan coupler corresponds to formula II

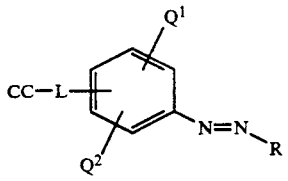

II in which

CC is a cyan coupler group to the coupling position of which L is attached;

L is a bifunctional connecting group;

$Q^1$, $Q^2$ represent H or photographically inert substituents;

R is a coupling component such that the compound of formula II is a yellow dye.

Colorless cyan couplers corresponding to formula I are known. In these couplers, $R^1$ is generally a phenyl group which may be substituted and which is advantageously substituted by at least one strongly electron-attracting substituent. $R^2$ essentially performs the function of a ballast group and preferably has an aryloxyalkyl structure. Examples of colorless cyan couplers corresponding to formula I are given in the following; further examples can be found in EP-A-0 028 099, in EP-A 0 067 689, in EP-A-1 084 100, in EP-A-0 087 930, in DE-A-3 443 700 and in DE-A-3 624 777.
C-1
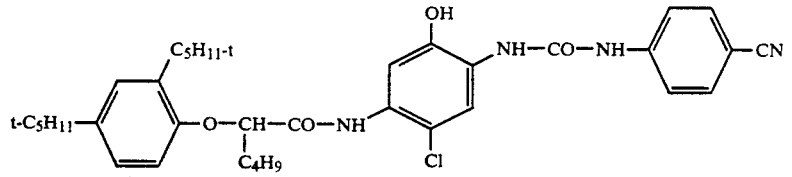
C-2
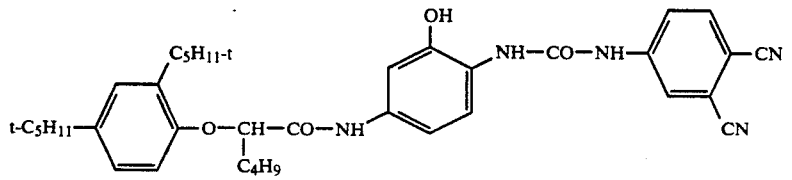
C-3
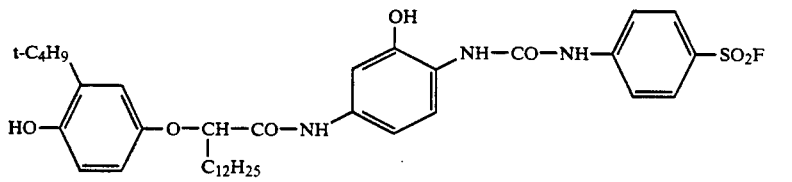
C-4
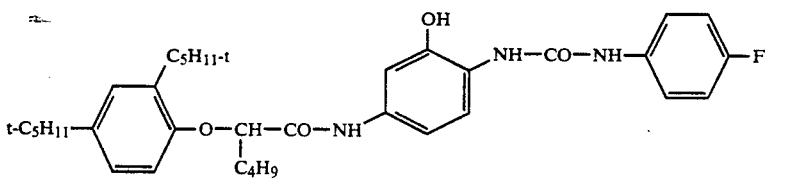
C-5
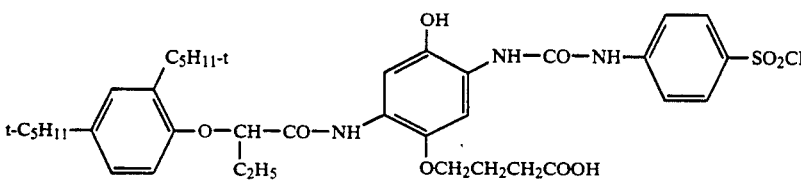
C-6
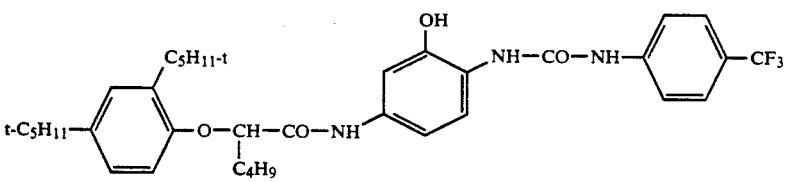
C-7
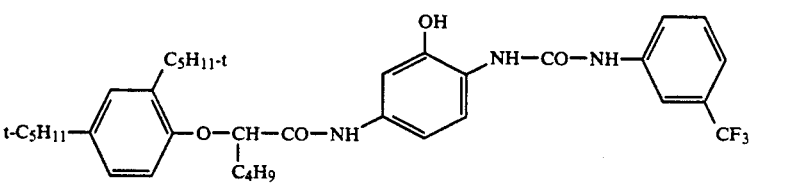
C-8
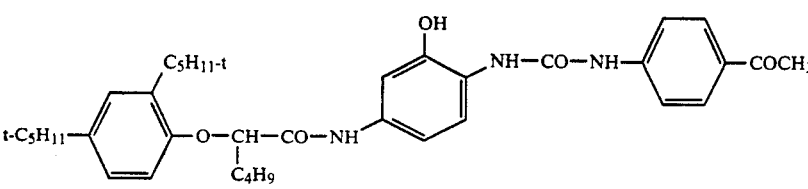

-continued

C-9

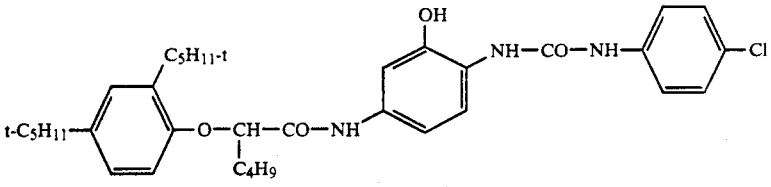

C-10

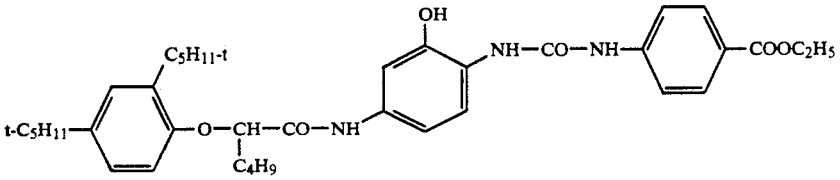

C-11

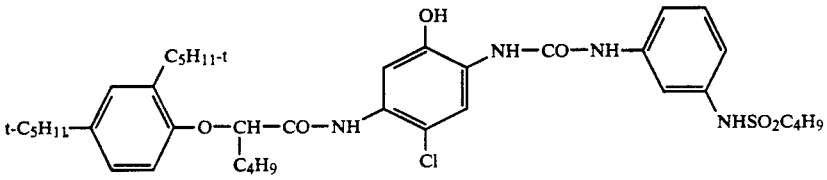

C-12

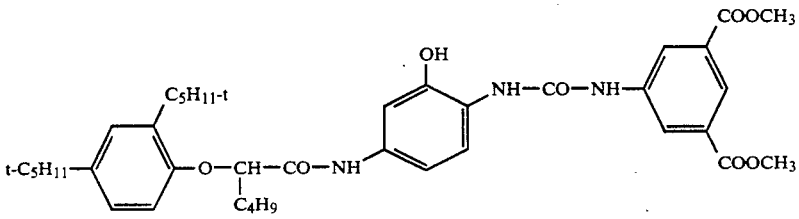

C-13

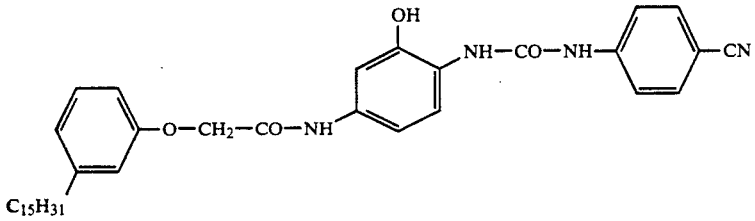

C-14

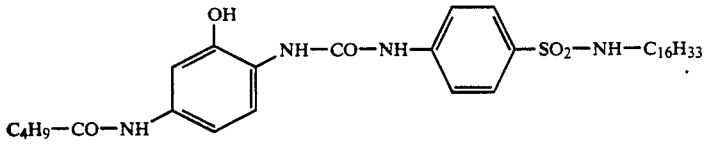

The cyan coupler residue represented by CC in formula II is, for example, the residue of a phenolic or naphtholic coupler. This residue generally has the following structure

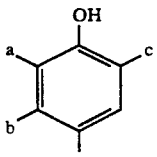

in which a is H, halogen or alkyl;

b is alkyl or acyl amino;

or a and b together represent the group required to complete a fused, optionally substituted, carbocyclic or heterocyclic ring and c is an acylamino group in the case of a phenolic coupler or a carbamoyl group in the case of a naphtholic coupler.

The cyan coupler residue represented by CC for example may also have the same coupling structure as a colorless coupler corresponding to formula I.

The bifunctional connecting group represented by L may have any structure providing ready separation from the coupling position is guaranteed during the color coupling reaction. In general, L is attached to the coupling position of the coupler through an oxygen, sulfur or nitrogen atom and may contain one or more of the following groups, optionally in alternation with alkylene or arylene groups:

—O—, —S—, —NH—$SO_2$—, —O—CO—, —O—CO—NH—, —CO—NH—, —$SO_2$—NH.

The photographically inert substituents represented by $Q^1$, $Q^2$ are, for example, halogen, alkoxy, alkyl, acylamino, carbamoyl, alkoxycarbonyl, CN, nitro or $CF_3$. Photographically inert means that these substituents do not significantly affect the photographic properties of the photosensitive recording material either before or after release of the azo dye. However, they may very well have an effect on the color of the azo dye or rather the colored coupler.

The coupling component represented by R is such that the azo dye formed or rather the colored coupler is yellow. A color photographic recording material colored with a coupler such as this absorbs essentially blue light and has an absorption maximum between 360 and 470 nm. Suitable coupling components have the following structures for example:

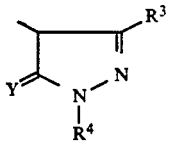
III

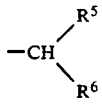
IV

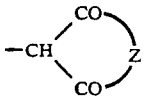
V

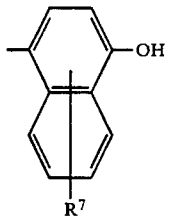
VI in which $R^3$ is alkyl, aryl, carboxyl, carbamoyl, acylamino, anilino;

$R^4$ is H, alkyl, aryl, a heterocyclic group;

$R^5$ $R^6$ (same or different) represent —CO-alkyl, —CO-aryl, —CO-alkoxy, carbamoyl, —CN;

$R^7$ represents H or one or more substituents such as halogen, carboxyl, sulfo, carbamoyl, sulfamoyl, acylamino;

Y represents O, S, NH;

Z is the group required to complete a 5- or 6-membered carbocyclic or heterocyclic ring.

An alkyl radical represented by $R^3$ or $R^4$ preferably contains 1 to 4 C atoms and may be substituted, for example by a carboxyl group. An aryl radical represented by $R_3$ or $R^4$ is preferably phenyl, optionally substituted, for example, by halogen, alkyl, alkoxy, acylamino, carbamoyl, sulfamoyl or sulfo. A heterocyclic group represented by $R^4$ is, for example, pyridyl, thienyl, benzthiazolyl.

The alkyl or alkoxy groups optionally present in $R^5$ and $R^6$ preferably contain 1 to 4 C atoms. The aryl radicals optionally present in $R^5$ and $R^6$ are, in particular, phenyl radicals which may be substituted by the same substituents as a phenyl radical represented by $R^3$ or $R^4$.

Carbamoyl and sulfamoyl ($R^3$ to $R^7$) include carbamoyl or sulfamoyl groups substituted at the N atom (for example by alkyl or aryl). Acylamino ($R^3$, $R^4$, $R^7$) includes acylamino groups of which the acyl group is derived from aliphatic or aromatic carbamic or sulfamic acids or carbonic acid monoesters.

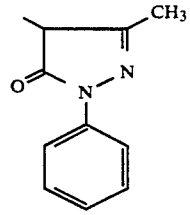
R-1

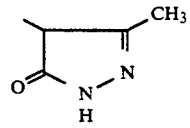
R-2

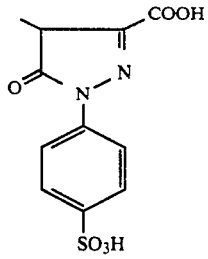
R-3

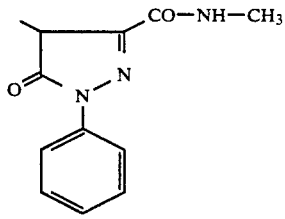
R-4

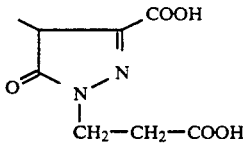
R-5

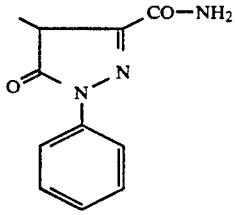
R-6

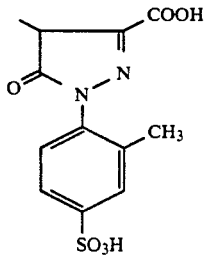
R-7

-continued
R-8
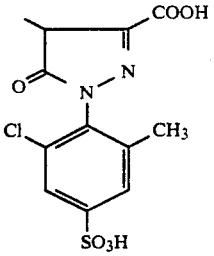
R-9
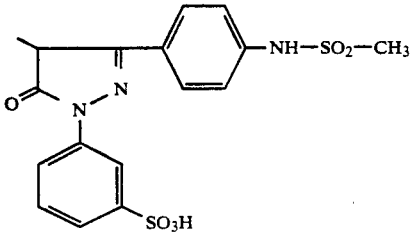
R-10
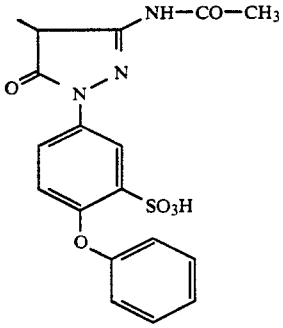
R-11
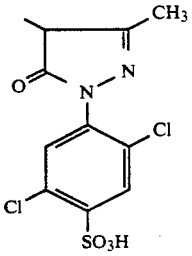
R-12
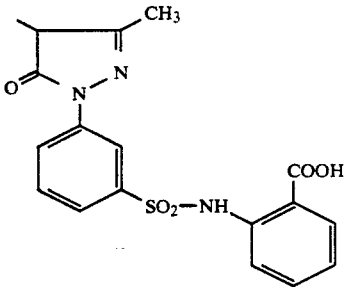
R-13
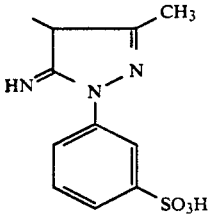
-continued
R-14
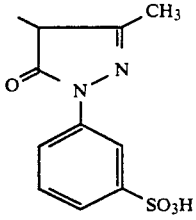
R-15
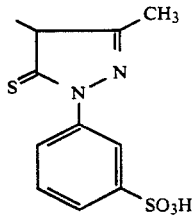
R-16
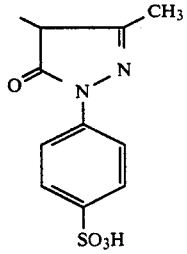
R-17
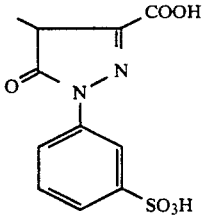
R-18
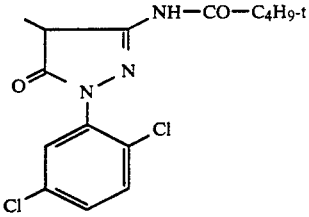
R-19
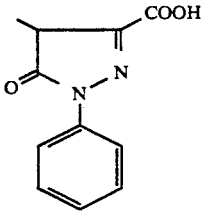
R-20
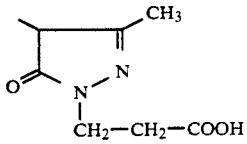

-continued

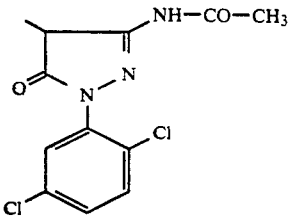

R-21

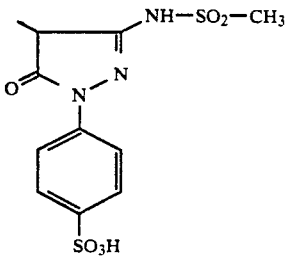

R-22

The following are examples of coupling components corresponding to formula III:

The following are example of residues of coupling components corresponding to formulae IV and V:

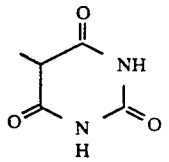

R-23

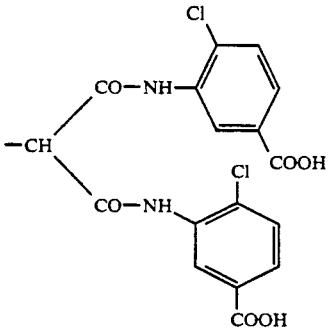

R-24

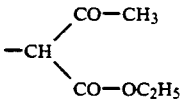

R-25

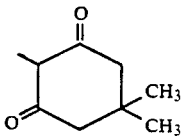

R-26

-continued

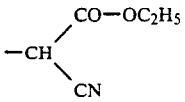

R-27

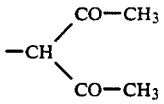

R-28

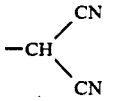

R-29

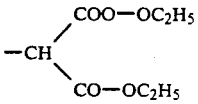

R-30

The following are examples of residues of coupling components corresponding to formula VI:

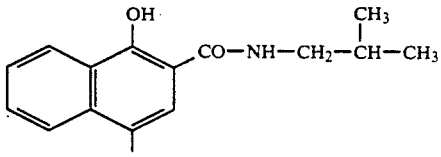

R-31

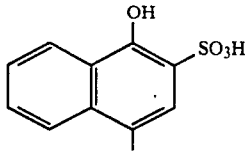

R-32

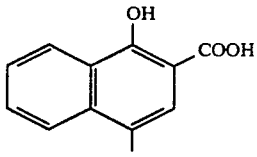

R-33

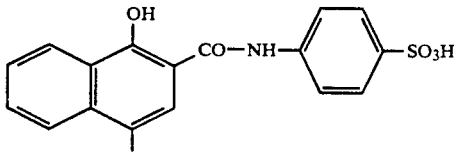

R-34

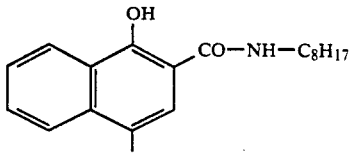

R-35

The following are examples of yellow cyan couplers of formula II according to the invention:

| R |
|---|
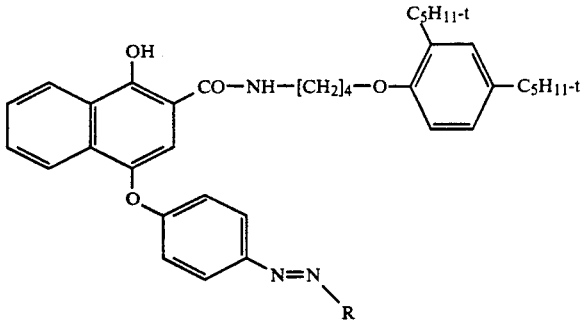
| | |
|---|---|
| II-1 | R-1 |
| II-2 | R-2 |
| II-3 | R-3 |
| II-4 | R-4 |
| II-5 | R-5 |
| II-6 | R-6 |
| II-7 | R-7 |
| II-8 | R-8 |
| II-9 | R-9 |
| II-10 | R-10 |
| II-11 | R-11 |
| II-12 | R-12 |
| II-13 | R-13 |
| II-14 | R-14 |
| II-15 | R-15 |
| II-16 | R-23 |
| II-17 | R-31 |
| II-18 | R-32 |
| II-19 | R-24 |
| II-20 | R-25 |
| II-21 | R-26 |
| II-22 | R-27 |
| II-23 | R-28 |
| II-24 | R-29 |
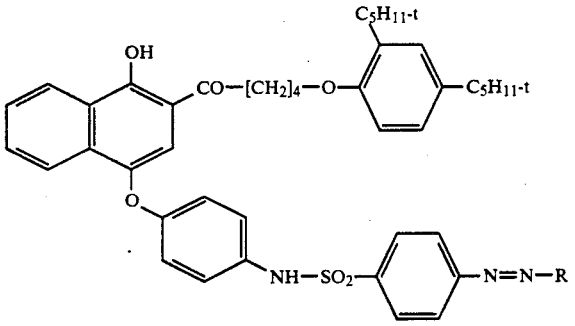
| | |
|---|---|
| II-25 | R = R-4 |
| II-26 | R = R-14 |
| II-27 | R = R-29 |
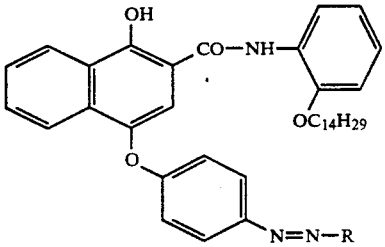
| | |
|---|---|
| II-28 | R = R-4 |
| II-29 | R = R-5 |
| II-30 | R = R-33 |

-continued
| R |
|---|
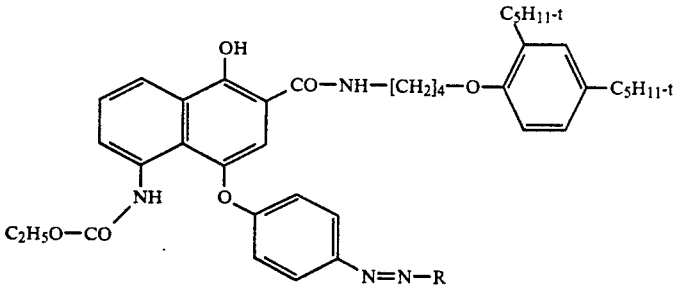
II-31 R = R-16
II-32 R = R-17
II-33 R = R-26
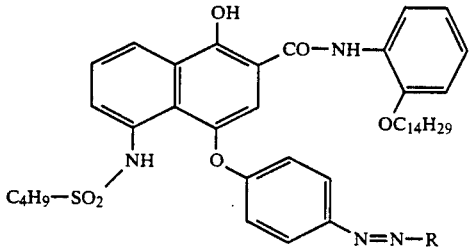
II-34 R = R-4
II-35 R = R-5
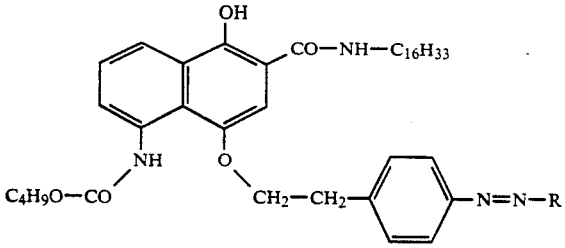
II-36 R = R-3
II-37 R = R-29
II-38 R = R-34
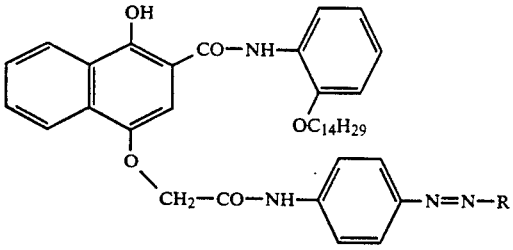
II-39 R = R-3
II-40 R = R-2
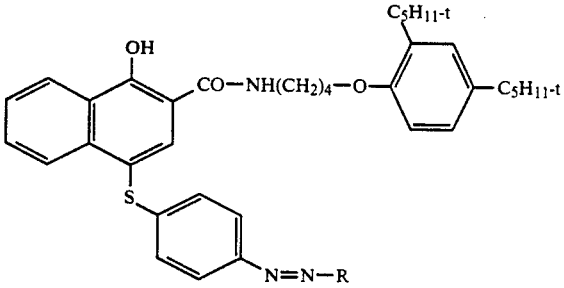

-continued
| | R |
|---|---|
| II-41 | R = R-3 |
| II-42 | R = R-13 |
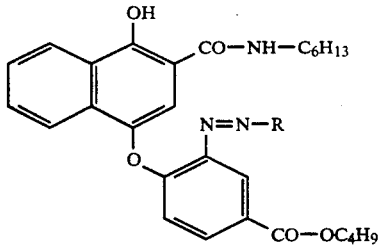
| | |
|---|---|
| II-43 | R = R-18 |
| II-44 | R = R-19 |
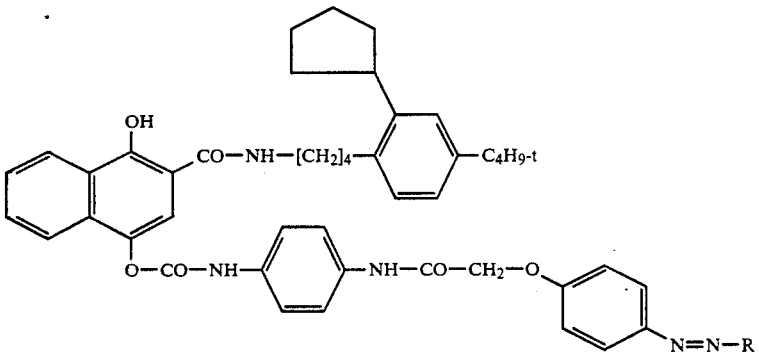
| | |
|---|---|
| II-45 | R = R-3 |
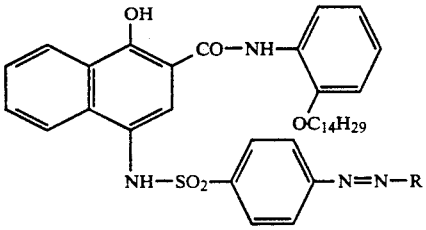
| | |
|---|---|
| II-46 | R = R-2 |
| II-47 | R = R-20 |
| II-48 | R = R-30 |
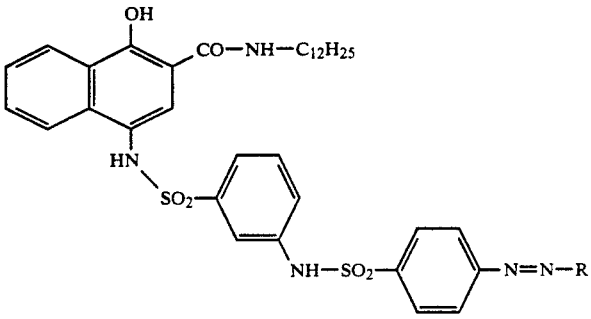
| | |
|---|---|
| II-49 | R = R-21 |

-continued

| R | |
|---|---|
| 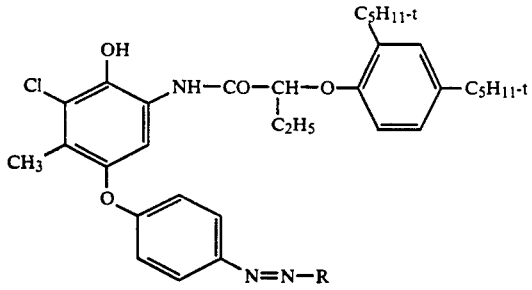 | |
| II-50 | R = R-3 |
| II-51 | R = R-13 |
| 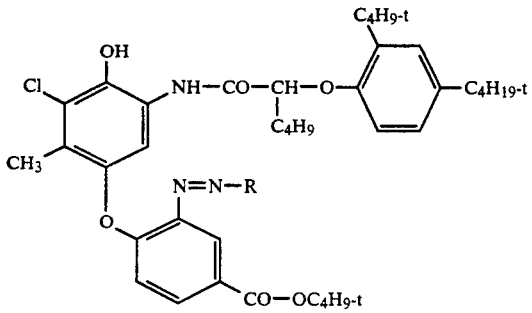 | |
| II-52 | R = R-3 |
| II-53 | R = R-22 |
| II-54 | R = R-29 |
| 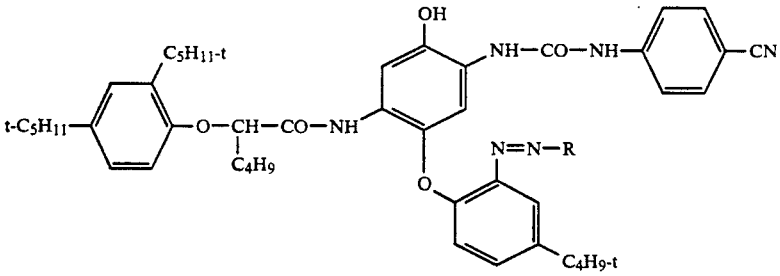 | |
| II-55 | R = R-3 |
| II-56 | R = R-5 |
| II-57 | R = R-35 |
| II-58 | R = R-29 |

Synthesis of the yellow cyan coupler corresponding to formula II-3 a. 480 g naphthyl hydroquinone carboxylic acid are dissolved under nitrogen in 3600 ml dimethylformamide and 480 g 40% aqueous sodium hydroxide. 366 g 4-nitrofluorobenzene are added to the resulting solution at 40° C., followed by heating to 60° C. The reaction mixture is stirred into aqueous hydrochloric acid, filtered under suction, washed and dried. 4-p-nitrophenoxy-2-naphtholcarboxylic acid is obtained in a yield of 727 g.

b. 406 g of the compound obtained in a. are stirred into 600 ml thionyl chloride. After stirring for 8 h at room temperature, the product precipitated is filtered off under suction and washed with a little acetonitrile. Yield: 385 g.

c. 276 g ω-(2,4-di-tert.-pentylphenoxy)-butylamine are dissolved in 450 ml acetonitrile and 279 g of the crystals obtained in b. are slowly added with stirring to the resulting solution. 180 ml triethylamine are then added dropwise. After stirring, the solution is concentrated, the residue is washed and dissolved out from acetonitrile. Yield: 4.8 g.

d. 184 g of the nitro compound obtained in c. are dissolved in 2 l tetrahydrofuran and hydrogenated with Raney nickel in a mildly alkaline medium at 80° C./50 bar. The product is concentrated, washed with water and taken up in 1500 ml ethanol.

e. 100 ml concentrated hydrochloric acid are added to the solution obtainable in d., followed by diazotization with 43 g sodium nitrite. The diazonium salt solution thus obtained is added to a solution of 85.5 g 1-(4-sulfophenyl)-5-pyrazolone-3-carboxylic acid in 1200 ml water and 120 g 30% sodium methylate at 5° to 10° C. The dye precipitated is filtered off under suction and washed with mixtures of methanol and water. The product is heated in acetonitrile and filtered under suction. Yield: 182 g.

In the production of the photosensitive color photographic recording material according to the invention, the non-diffusing colorless cyan couplers corresponding to formula I and the colored cyan couplers corresponding to formula II may be incorporated in known manner in the casting solution of the silver halide emulsion layers or other colloid layers. For example, the oil-soluble or hydrophobic couplers may be added to a hydrophilic colloid solution, preferably from a solution in a suitable coupler solvent (oil former), optionally in the presence of a wetting agent or dispersant. The hydrophilic casting solution may of course contain other standard additives in addition to the binder. The solution of the coupler does not have to be directly dispersed in the casting solution for the silver halide emulsion layer or any other water-permeable layer. Instead, it may even be initially dispersed with advantage in an aqueous non-photosensitive solution of a hydrophilic colloid, after which the mixture obtained is mixed with the casting solution for the photosensitive silver halide emulsion layer or any other water-permeable layer before application, optionally after removal of the low-boiling organic solvent used. The couplers of formula I and the couplers of formula II may even be separately added and need not necessarily be added to the same layer.

The photosensitive silver halide emulsions used may contain as halide chloride, bromide and iodide or mixtures thereof. In one preferred embodiment, 0 to 12 mol-% of the halide component of at least one layer consists of iodide, 0 to 50 mol-% of chloride and 50 to 100 mol-% of bromide. In one preferred embodiment, the silver halide may consist of predominantly compact crystals which may have, for example, a cubic or octahedral form or transitional forms and which generally have a mean grain size of more than 0.2 μm. The average diameter-to-thickness ratio is preferably less than 8:1, the diameter of a crystal being defined as the diameter of a circle with an area corresponding to the projected area of the crystal. In another preferred embodiment, however, all the emulsions or individual emulsions may also comprise essentially platy silver halide crystals in which the diameter-to-thickness ratio is greater than 8:1. The emulsions may be monodisperse emulsions which preferably have a mean grain size of 0.3 μm to 1.2 μm. The silver halide crystals may have a multilayer structure.

Suitable protective colloids or binders for the layers of the recording material are the usual hydrophilic film-forming agents, for example proteins, particularly gelatine. However, the gelatine may be completely or partly replaced by other natural or synthetic binders. Casting aids and plasticizers may be used, cf. Research Disclosure 17 643 (December 1978), particularly Chapters IX, XI and XII.

The emulsions may be chemically or spectrally sensitized in the usual way and may be stabilized with the usual silver halide stabilizers. The emulsion layers and other non-photosensitive layers may be hardened in the usual way with known hardeners. Suitable chemical sensitizers, spectral sensitizing dyes, stabilizers and hardeners are described, for example, in Research Disclosure 17 643, cf. in particular Chapters III, IV, VI and X.

Color photographic recording materials normally contain at least one silver halide emulsion layer for recording light of each of the three spectral regions red, green and blue. To this end, the photosensitive layers are spectrally sensitized in known manner by suitable sensitizing dyes. Blue-sensitive silver halide emulsion layers need not necessarily contain a spectral sensitizer because, in many cases, the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-l 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-25 30 645, DE-A-26 22 922). Partial silver halide layers such as these of the same spectral sensitivity generally show different sensitivity to light (speed), the more sensitive partial layers generally being arranged further away from the layer support than less sensitive partial layers of the same spectral sensitivity.

Color photographic recording materials for the production of multicolor images normally contain dye-producing compounds, in the present case particularly color couplers, for producing the different component dye images cyan, magenta and yellow in spatial and spectral association with the silver halide emulsion layers of different spectral sensitivity.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, in the present case at least one colorless cyan coupler corresponding to formula I and at least one yellow cyan coupler corresponding to formula II, is associated with red-sensitive silver halide emulsion layers. In addition, a red or magenta secondary density of the cyan dye which may still be present may also be masked providing one of the usual red mask couplers is associated with the red-sensitive layers. Red cyan couplers of the type in question are known and are described, for example in DE-A-25 38 323. At least one non-diffusing color coupler for producing the magenta component dye image, normally a color coupler of the 5-pyrazolone type, the indazolone type or any of various pyrazoloazoles, is associated with green-sensitive silver halide emulsion layers; pyrazoloazoles of the type in question are described, for example, in DE-A-35 16 996. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Reference is made here, for example, to the publications entitled "Farbkuppler (Color Couplers)" by W. PELZ in "Mitteilungen aus den Forschungslaboratorien der Agfa, Leverkusen/München", Vol. III, page 111 (1961) and by K VENKATARAMAN in "The Chemistry of Synthetic Dyes", Vol. 4, 341 to 387, Academic Press (1971).

The color couplers may be both typical 4-equivalent couplers and also 2-equivalent couplers in which a smaller quantity of silver halide is required for dye production. 2-Equivalent couplers are known to be derived from the 4-equivalent couplers in that they contain in the coupling position a substituent which is eliminated during the coupling reaction. 2-Equivalent couplers include both those which are substantially colorless and also those which, like the yellow cyan couplers of formula II used in accordance with the invention for example, have a strong color of their own which either disappears during the color coupling reaction or is replaced by the color of the image dye produced. Couplers of the latter type may also be additionally present in the photosensitive silver halide emulsion layers where they serve as mask couplers to compensate the unwanted secondary densities of the image dyes. However, 2-equivalent couplers also include the known white couplers, although couplers such as these do not produce a dye on reaction with color developer oxidation products. 2-Equivalent couplers also include the known DIR, DAR and FAR couplers, i.e. couplers which, in the coupling position, contain a releasable group which is released as a diffusing development inhibitor, development accelerator or diffusing fogging agent on reaction with developer oxidation products. The couplers, including the compounds of formula II used in accordance with the invention, may also be used in polymeric form, for example as a polymer latex.

High molecular weight color couplers are described, for example, in DE-C-1 297 417, DE-A-2 407 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,311. The high molecular weight color couplers are generally produced by polymerization of ethylenically unsaturated monomeric color couplers.

The color couplers used may also be those which give dyes having slight or limited mobility.

By slight or limited mobility is meant a mobility which is gauged in such a way that the contours of the discrete dye patches formed during chromogenic development blend and merge with one another. This degree of mobility should be distinguished, on the one hand, from the usual case of complete immobility in photographic layers which, in conventional photographic recording materials, is required for the color couplers or rather for the dyes produced therefrom in order to obtain maximal definition and, on the other hand, from the case of total mobility of the dyes as required, for example, in dye diffusion processes. The last-mentioned dyes generally have at least one group which makes them soluble in the alkaline medium. The extent of the slight mobility required in accordance with the invention may be controlled by variation of substituents in order, for example, specifically to influence solubility in the organic medium of the oil former or affinity for the binder matrix.

In addition to the constituents mentioned above, the color photographic recording material according to the invention may contain other additives, such as for example antioxidants, dye stabilizers and agents for influencing the mechanical and electrostatic properties. In order to reduce or avoid the adverse effect of UV light on the dye images produced with the color photographic recording material according to the invention, it is of advantage for example to use UV absorbers in one or more of the layers present in the recording material, preferably in one of the upper layers. Suitable UV absorbers are described, for example, in U.S Pat. No. 3,253,921, in DE-C-2 036 719 and in EP-A-0 057 160.

To produce color photographic images, the color photographic recording material according to the invention, which contains at least one silver halide emulsion layer and at least one coupler of formula I associated therewith, is developed with a color developer compound. Suitable color developer compounds are any developer compounds which are capable of reacting with color couplers in the form of their oxidation product to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methylsulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine.

Other useful color developers are described, for example, in J. Amer. Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately or even together with one another. Suitable bleaches are any of the usual compounds, for example $Fe^{3+}$ salts and $Fe^{3+}$ complex salts, such as ferricyanides, dichromates, water-soluble cobalt complexes, etc. Particular preference is attributed to iron(III) complexes of aminopolycarboxylic acids, more especially for example ethylenediamine tetraacetic acid, N-hydroxyethyl ethylene-diamine triacetic acid, alkyliminodicarboxylic acids and of corresponding phosphonic acids. Persulfates are also suitable bleaches.

The compounds of formula II are not only suitable as mask couplers, they may also be used as filter dyes, partiicularly where they are hydrophilic. This is particularly important in high-sensitivity films which are made up on the principle of so-called sensitivity packs, in which the compounds corresponding to formula II may be used in the layers of highest sensitivity and may be considered as a substitute for colloidal silver filter yellow. This has above all the advantage that the contact fog induced by colloidal silver can be effectively avoided.

An advantageous color photographic recording material of this type contains, for example on a layer support, the following layers in the order shown optionally separated by non-photosensitive intermediate layers:

- a comparatively low-sensitivity red-sensitized layer containing a cyan coupler
- a comparatively low-sensitivity green-sensitized layer containing a magenta coupler
- a comparatively low-sensitivity blue-sensitive layer containing a yellow coupler
- a comparatively high-sensitivity red-sensitized layer containing a compound of formula II and, optionally, a cyan coupler (advantageously a cyan coupler corresponding to formula I)
- a comparatively high-sensitivity green-sensitized layer containing a magenta coupler
- a comparatively high-sensitivity blue-sensitized layer containing a yellow coupler.

EXAMPLE 1

A color photographic recording material for color negative development was prepared by applying the following layers in the order indicated to a transparent layer support of cellulose triacetate. The quantities applied are all based on one square meter. For the silver halide applied, the corresponding quantities of $AgNO_3$ are indicated. All the silver halide emulsions were stabilized with 0.5 g 4-hydroxy-6-methyl-1,3,3a,7-tetraazaindene per 100 g $AgNO_3$.

Layer 1 (Antihalolayer)
  black colloidal silver sol containing 0.32 g Ag and 2.2 g gelatine
Layer 2 (Intermediate layer)
  0.3 g gelatine
Layer 3 (First red-sensitized layer)
  red-sensitized silver chloride bromide iodide emulsion (5 mol-% iodide; 2 mol-% chloride; mean grain diameter 0.5 μm) of
  2.4 g $AgNO_3$,
  0.9 mmol colorless cyan coupler (Table 1) colored cyan coupler (Table 1)
  0.025 g DIR coupler DC-1
  1.2 g gelatine
Layer 4 (Second red-sensitized layer)
  red-sensitized silver bromide iodide emulsion (10 mol-% iodide; mean grain diameter 0.8 μm) of
  2.9 g $AgNO_3$,
  0.25 mmol colorless cyan coupler (Table 1) colored cyan coupler (Table 1)
  0.04 g DIR compound DC-2
Layer 5 (Intermediate layer)
  0.9 g gelatine
Layer 6 (First green-sensitized layer)
  green-sensitized silver bromide iodide emulsion (5 mol-% iodide; mean grain diameter 0.4 μm) of
  2.2 g $AgNO_3$,
  0.65 g magenta coupler M-1
  0.04 g DIR coupler DC-3
  0.02 g yellow mask MY-1
  1.4 g gelatine
Layer 7 (Second green-sensitized layer)
  green-sensitized silver bromide iodide emulsion (10 mol-% iodide; mean grain diameter 0.8 μm) of
  2.7 g $AgNO_3$,
  0.17 g magenta coupler M-1
  0.04 g yellow mask MY-1
  1.6 g gelatine
Layer 8 (Yellow filter layer)
  yellow colloidal silver sol containing
  0.07 g Ag and 0.32 g gelatine
Layer 9 (First blue-sensitive layer)
  silver bromide iodide emulsion (3 mol-% iodide; mean grain diameter 0.3 μm) of
  0.95 g $AgNO_3$,
  0.96 g yellow coupler Y-1
  1.4 g gelatine
Layer 10 (Second blue-sensitive layer)
  silver bromide iodide emulsion (8 mol-% iodide; mean grain diameter 0.8 μm) of
  1.0 g $AgNO_3$,
  0.22 g yellow coupler Y-1
  1.6 g gelatine
Layer 11 (Protective layer)
  1.1 g gelatine and
  0.8 g UV absorber UV-1
Layer 12 (Protective layer)
  0.8 g gelatine
Layer 13 (Hardening layer)
  0.3 g gelatine and
  0.9 hardener [CAS Reg. no. 65411-60-1]

The formulae of the compounds used in Example 1 are shown in the following:

MR-1
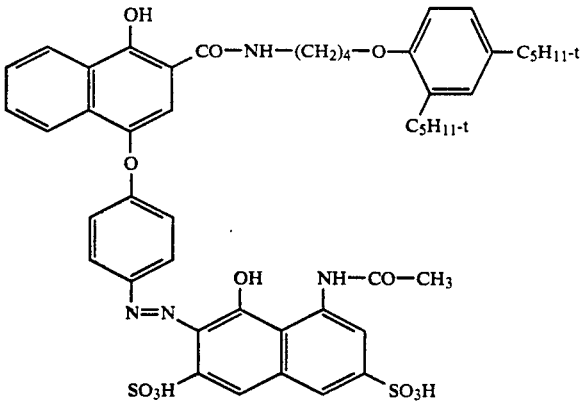
MR-2
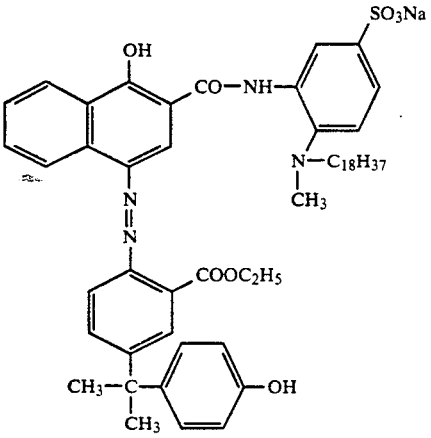
DC-1
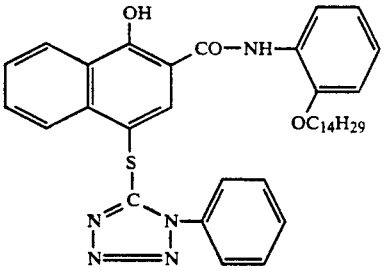
DC-2
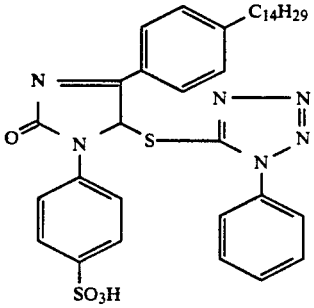

-continued

M-1

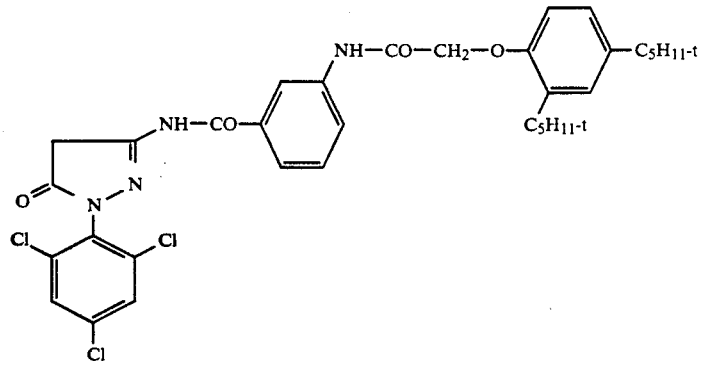

DC-3

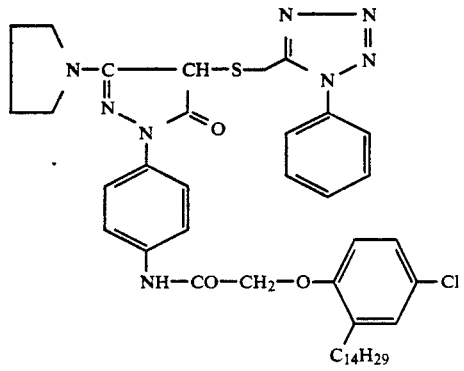

MY-1

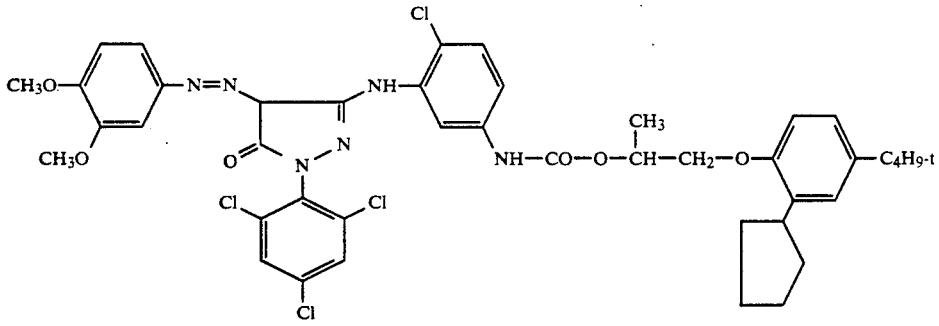

Y-1

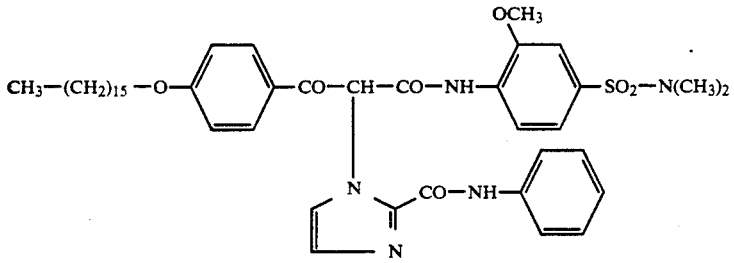

UV-1

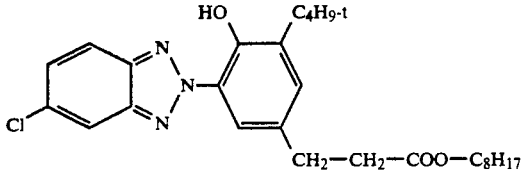

Various versions of the described recording material were prepared, differing from one another solely in the colorless and colored cyan couplers introduced into layer 3 and layer 4.

General procedure for dispersion of the cyan couplers 100 g coupler were dissolved together with 80 g dibutyl phthalate in 300 ml ethyl acetate and the resulting solution incorporated by emulsification at 50° C. in 1.3 l of 7.5% gelatine likewise heated to 50° C. to which 10 g sodium dodecylbenzene sulfonate had also been added. The low-boiling solvent was then removed in vacuo and the remaining dispersion allowed to solidify at 6° C.

The color table described in U. Vielmuth, Fernseh- und Kino-Technik 1/1979, page 21, was exposed onto the various materials. After processing as described in Brit. J. of Photography, 1979, pages 597 et seq., the corresponding negatives were copied onto type 8 Agfa color paper (technical data A 81 of Agfa Gevaert AG). The reproduction of blue and yellow was then colorimetrically evaluated in accordance with DIN 6174 using the CJELAB 1976 system. It can be seen from Table 1 that the saturation of blue and yellow (columns 5 and 6) is distinctly higher in the combinations according to the invention than in the Comparison Examples.

Formally negative secondary densities (column 7) signify overmasking and, hence, a higher interimage effect which favorably affects color reproduction in the same way as the higher saturation.

Typical mask couplers coupling from red or magenta to cyan (samples 2 and 3) are not sufficient for obtaining optimal color reproduction together with the colorless cyan couplers used in accordance with the invention.

TABLE 1

| Sample | Colorless cy-coupler in layers 3 and 4 | Colored cy-coupler [mmol] layer 3 | Colored cy-coupler [mmol] layer 4 | Color saturation ΔC against original blue | Color saturation ΔC against original yellow | Yellow secondary density [%] of the cy dye image |
|---|---|---|---|---|---|---|
| 1 | C-2 and C-4 (1:1) | — | — | −12.3 | −4.3 | 8 |
| 2 | C-2 and C-4 (1:1) | 0.045 MR-1 | — | −6.0 | 0.8 | 0 |
| 3 | C-2 and C-4 (1:1) | 0.10 MR-2 | — | −9.5 | 0.3 | 1 |
| 4 | C-2 and C-4 (1:1) | 0.12 II-2 | — | −3.5 | 1.8 | −8 |
| 5 | C-2 and C-4 (1:1) | 0.24 II-2 | — | −1.1 | 2.3 | −25 |
| 6 | C-2 and C-4 (1:1) | 0.16 II-3 | 0.08 II-3 | −2.6 | 1.5 | −16 |

cy = cyan

EXAMPLE 2

The procedure was as in Example 1 using further colorless cyan couplers according to the invention together with colored cyan couplers according to the invention or (for comparison) without them. A material which contained a comparison naptholic cyan coupler, but no colored cyan coupler, was also tested for comparison (sample 7). The results are shown in Table 2. The following naphtholic cyan coupler VC-1 was used as the comparison coupler:

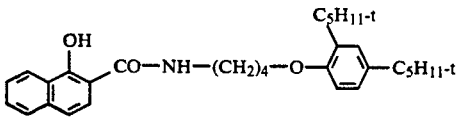

VC-1

TABLE 2

| Sample | Colorless cy-coupler in layers 3 and 4 | Colored cy-coupler [mmol] layer 3 | Colored cy-coupler [mmol] layer 4 | Color saturation ΔC against original blue | Color saturation ΔC against original yellow | Yellow secondary density [%] of the cy dye image |
|---|---|---|---|---|---|---|
| 7 | VC-1 | — | — | −5.9 | +1.2 | 4 |
| 8 | C-1 | — | — | −11.7 | −2.9 | 7 |
| 9 | C-1 | II-3 | — | −2.7 | +2.1 | −9 |
| 10 | C-1 | II-17 | — | −5.1 | +1.3 | −3 |
| 11 | C-3 | — | — | −13.2 | −4.9 | 9 |
| 12 | C-3 | II-25 | — | −6.5 | +0.6 | −2 |

It can be seen from Table 2 that, where the colored cyan couplers according to the invention are additionally used, the blue and yellow reproduction of the dye images obtained from the colorless cyan couplers used in accordance with the invention is distinctly improved. The colored cyan couplers used in accordance with the invention are particularly suitable for compensating the comparatively high yellow secondary density of the dye images produced from the colorless cyan couplers used in accordance with the invention.

I claim:

1. A color photographic recording material comprising at least one photographic silver halide emulsion layer which is applied to a layer support and with which a colorless cyan coupler and a colored cyan coupler are associated, characterized in that the colorless cyan coupler corresponds to formula I below

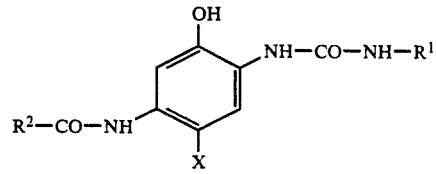

I in which

X is H or a group releasable during the coupling reaction;

$R^1$ is a heterocyclic group or aryl;

$R^2$ is a ballast group;

and in that the colored cyan coupler corresponds to formula II:

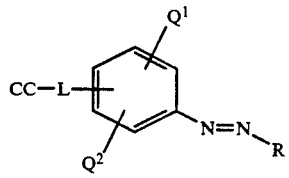

II in which

CC is a cyan coupler residue to the coupling position of which L is attached;

L is a bifunctional connecting group;

$Q^1$, $Q^2$ represent H or photographically inert substituents;

R represents a coupling component having a structure corresponding to one of formula III, IV and V:

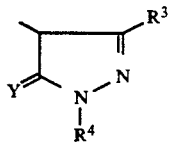

III

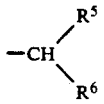

IV

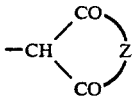

V in which $R^3$ is alkyl, aryl, carboxyl, carbamoyl, acylamino, anilino;

$R^4$ is H, alkyl, aryl, a heterocyclic group;

$R^5$, $R^6$ (same or different) represent —CO-alkyl, —CO-aryl, —CO-alkoxy, carbamoyl, —CN;

Y represents O, S, NH;

Z is the group required to complete a 5- or 6-membered carbocyclic or heterocyclic ring.

2. A recording material as claimed in claim 1, characterized in that the cyan coupler residue represented by CC in formula II generally has the following structure;

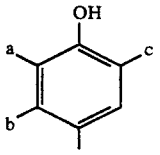

in which a represents H, halogen or alkyl;

b represents alkyl or acylamino;

or a and b together represent the group required to complete a fused, optionally substituted, carbocyclic or heterocyclic ring and c is an acylamino group in the case of a phenolic coupler and a carbamoyl group in the case of a naphtholic coupler.

* * * * *